US010025247B2

(12) United States Patent
Sawada et al.

(10) Patent No.: US 10,025,247 B2
(45) Date of Patent: Jul. 17, 2018

(54) FIXING DEVICE INCLUDING A PRESSURE PAD WITH AT LEAST ONE MOUTH, AND IMAGE FORMING APPARATUS INCORPORATING SAME

(71) Applicants: Kazunari Sawada, Kanagawa (JP); Ippei Fujimoto, Kanagawa (JP); Kenji Ishii, Kanagawa (JP); Takashi Seto, Kanagawa (JP); Takayuki Seki, Kanagawa (JP); Hiroshi Yoshinaga, Chiba (JP); Ryohei Matsuda, Kanagawa (JP)

(72) Inventors: Kazunari Sawada, Kanagawa (JP); Ippei Fujimoto, Kanagawa (JP); Kenji Ishii, Kanagawa (JP); Takashi Seto, Kanagawa (JP); Takayuki Seki, Kanagawa (JP); Hiroshi Yoshinaga, Chiba (JP); Ryohei Matsuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/447,709

(22) Filed: Mar. 2, 2017

(65) Prior Publication Data

US 2017/0261900 A1 Sep. 14, 2017

(30) Foreign Application Priority Data

Mar. 11, 2016 (JP) ..... 2016-048112
Jan. 20, 2017 (JP) ..... 2017-008283
Feb. 16, 2017 (JP) ..... 2017-026752

(51) Int. Cl.
*G03G 15/20* (2006.01)

(52) U.S. Cl.
CPC ..... *G03G 15/2089* (2013.01); *G03G 15/206* (2013.01); *G03G 2215/2035* (2013.01)

(58) Field of Classification Search
CPC ..... G03G 15/2089; G03G 15/2053; G03G 15/206; G03G 2215/2035
(Continued)

(56) References Cited

U.S. PATENT DOCUMENTS 6,456,819 B1 * 9/2002 Abe ..... G03G 15/2064 219/216
8,219,016 B2 * 7/2012 Hasegawa ..... G03G 15/2064 399/122
(Continued)

FOREIGN PATENT DOCUMENTS

JP 2014-199409 10/2014

*Primary Examiner* — Robert Beatty
(74) *Attorney, Agent, or Firm* — Oblon, McClelland, Maier & Neustadt, L.L.P.

(57) ABSTRACT

A fixing device includes fixing rotator, a heater to heat the fixing rotator, a pressure rotator disposed opposite an outer circumferential surface of the fixing rotator, a pressure pad disposed opposite an inner circumferential surface of the fixing rotator, a support to support the pressure pad, and a thermal conduction aid to conduct heat in an axial direction of the fixing rotator. The pressure pad presses against the pressure rotator via the fixing rotator to form a fixing nip between the fixing rotator and the pressure rotator. The pressure pad includes a nip-side face disposed opposite the inner circumferential surface of the fixing rotator. The thermal conduction aid covers the nip-side face of the pressure pad. The nip-side face of the pressure pad includes at least one mouth therein defining a non-contact area in which the pressure pad does not contact the thermal conduction aid.

16 Claims, 11 Drawing Sheets

(58) Field of Classification Search
USPC ..... 399/329
See application file for complete search history.

(56) References Cited

U.S. PATENT DOCUMENTS

| | | | | |
|---|---|---|---|---|
| 9,291,966 | B2 * | 3/2016 | Shoji | G03G 15/2053 |
| 9,342,010 | B2 * | 5/2016 | Shimura | G03G 15/2042 |
| 2007/0189818 | A1 * | 8/2007 | Kondo | G03G 15/2064 399/329 |
| 2011/0135358 | A1 * | 6/2011 | Kikuchi | G03G 15/2064 399/329 |
| 2015/0030362 | A1 | 1/2015 | Bae et al. | |
| 2016/0161890 | A1 | 6/2016 | Shoji et al. | |
| 2016/0223961 | A1 | 8/2016 | Takagi et al. | |
| 2016/0274511 | A1 * | 9/2016 | Ogino | G03G 15/2053 |
| 2016/0274514 | A1 | 9/2016 | Ishii et al. | |
| 2016/0334742 | A1 | 11/2016 | Kobashigawa et al. | |
| 2016/0378027 | A1 | 12/2016 | Sawada et al. | |
| 2017/0176906 | A1 * | 6/2017 | Sawada | G03G 15/2053 |

* cited by examiner

FIXING DEVICE INCLUDING A PRESSURE PAD WITH AT LEAST ONE MOUTH, AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2016-048112, filed on Mar. 11, 2016, 2017-008283, filed on Jan. 20, 2017, and 2017-026752, filed on Feb. 16, 2017, in the Japan Patent Office, the entire disclosure of each of which is hereby incorporated by reference herein.

BACKGROUND

Technical Field

Embodiments of the present disclosure generally relate to a fixing device and an image forming apparatus incorporating the fixing device, and more particularly, to a fixing device for fixing a toner image on a recording medium, and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical scanner irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, the image is formed on the recording medium.

Such a fixing device typically includes a fixing rotator, such as a roller, a belt, and a film, and a pressure rotator, such as a roller and a belt, pressed against the fixing rotator. The fixing rotator and the pressure rotator apply heat and pressure to the recording medium, melting and fixing the toner image onto the recording medium while the recording medium is conveyed between the fixing rotator and the pressure rotator.

SUMMARY

In one embodiment of the present disclosure, a novel fixing device is described that includes a fixing rotator, a heater, a pressure rotator, a pressure pad, a support, and a thermal conduction aid. The fixing rotator is formed into a loop and rotatable in a predetermined direction of rotation. The heater heats the fixing rotator. The pressure rotator is disposed opposite an outer circumferential surface of the fixing rotator. The pressure pad is disposed opposite an inner circumferential surface of the fixing rotator. The pressure pad presses against the pressure rotator via the fixing rotator and forms a fixing nip between the fixing rotator and the pressure rotator. The pressure pad includes a nip-side face disposed opposite the inner circumferential surface of the fixing rotator. The support supports the pressure pad. The thermal conduction aid conducts heat in an axial direction of the fixing rotator. The thermal conduction aid covers the nip-side face of the pressure pad. The nip-side face of the pressure pad includes at least one mouth defining a non-contact area of the pressure pad in the at least one mouth. The pressure pad does not contact the thermal conduction aid in the non-contact area of the pressure pad.

Also described is a novel image forming apparatus incorporating the fixing device.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
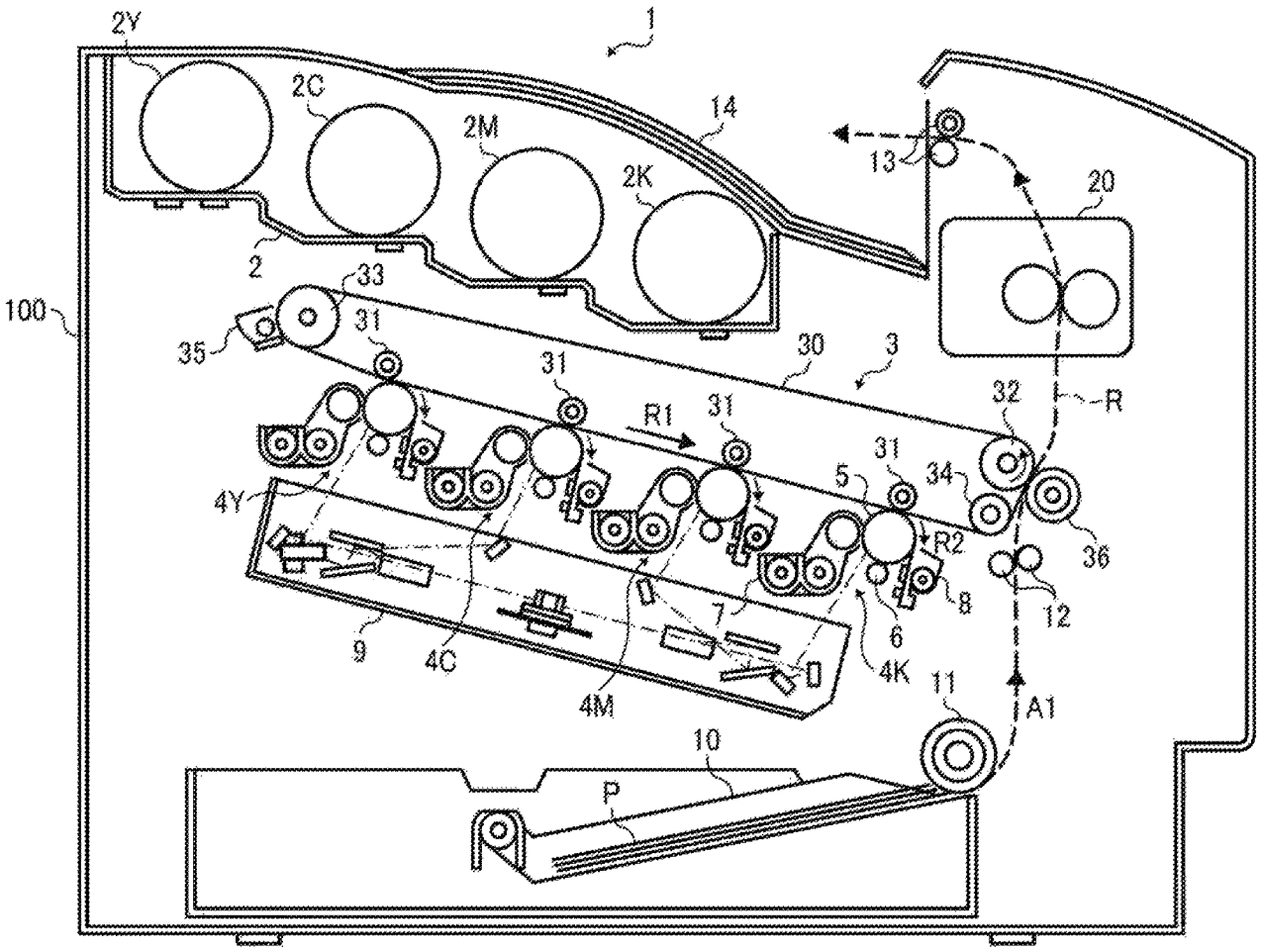
FIG. 1 is a schematic view of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, C, M, and K denote colors yellow, cyan, magenta, and black, respectively. To simplify the description, these suffixes are omitted unless necessary.

Referring now to the drawings, embodiments of the present disclosure are described below.

Initially with reference to FIG. 1, a description is given of an overall construction of an image forming apparatus 1 according to an embodiment of the present disclosure.

FIG. 1 is a schematic cross-sectional view of the image forming apparatus 1.

The image forming apparatus 1 may be a copier, a facsimile machine, a printer, a multifunction peripheral or multifunction printer (MFP) having at least one of copying, printing, scanning, facsimile, and plotter functions, or the like. According to the present embodiment, the image forming apparatus 1 is a color printer that forms color and monochrome toner images on a recording medium by electrophotography. Alternatively, the image forming apparatus 1 may be a monochrome printer that forms a monochrome toner image on a recording medium. As illustrated in FIG. 1, the image forming apparatus 1 includes, e.g., four image forming devices 4Y, 4C, 4M, and 4K and an intermediate transfer belt 30. The image forming devices 4Y, 4C, 4M, and 4K are situated in the center of a housing 100 of the image forming apparatus 1, and arranged side by side along a direction in which the intermediate transfer belt 30 is stretched. The image forming devices 4Y, 4C, 4M, and 4K have identical configurations while containing different colors of toner as developer. Specifically, the image forming devices 4Y, 4C, 4M, and 4K contain toner of yellow (Y), cyan (C), magenta (M), and black (K), respectively. The colors yellow, cyan, magenta, and black correspond to color separation components of a color image.

Each of the image forming devices 4Y, 4C, 4M, and 4K is an image station that includes, e.g., a drum-shaped photoconductor 5 as a latent image bearer, a charger 6 that charges the surface of the photoconductor 5, a developing device 7 that supplies toner to an electrostatic latent image formed on the surface of the photoconductor 5, and a cleaner 8 that cleans the surface of the photoconductor 5, as illustrated in the image forming device 4K of FIG. 1, for example.

Below the image forming devices 4Y, 4M, 4C, and 4K is an exposure device 9 that exposes the surface of the photoconductor 5. The exposure device 9 includes, e.g., a light source, a polygon mirror, an f-θ lens, and a reflection mirror to irradiate the surface of the photoconductor 5 with a laser beam according to image data.

A transfer device 3 is disposed above the image forming devices 4Y, 4C, 4M, and 4K. The transfer device 3 includes the intermediate transfer belt 30 as a transfer body, four primary transfer rollers 31 as primary transfer devices, a secondary transfer roller 36 as a secondary transfer device, a secondary transfer backup roller 32, a cleaning backup roller 33, a tension roller 34, and a belt cleaner 35.

The intermediate transfer belt 30 is an endless belt entrained around the secondary transfer backup roller 32, the cleaning backup roller 33, and the tension roller 34. In the present embodiment, as a driver drives and rotates the secondary transfer backup roller 32 counterclockwise, the intermediate transfer belt 30 rotates in a counter-clockwise direction of rotation R1 as illustrated in FIG. 1 by friction therebetween.

The four primary transfer rollers 31 sandwich the intermediate transfer belt 30 together with the respective photoconductors 5, thereby forming four primary transfer areas herein referred to as primary transfer nips between the intermediate transfer belt 30 and the photoconductors 5. The primary transfer rollers 31 are coupled to a power supply disposed inside the image forming apparatus 1. The power supply applies at least one of a predetermined direct current (DC) voltage and a predetermined alternating current (AC) voltage to each of the primary transfer rollers 31.

The secondary transfer roller 36 sandwiches the intermediate transfer belt 30 together with the secondary transfer backup roller 32, thereby forming a secondary transfer area herein referred to as a secondary transfer nip between the secondary transfer roller 36 and the intermediate transfer belt 30. Similar to the primary transfer rollers 31, the secondary transfer roller 36 is coupled to the power supply disposed inside the image forming apparatus 1. The power supply applies at least one of a predetermined direct current (DC) voltage and a predetermined alternating current (AC) voltage to the secondary transfer roller 36.

The belt cleaner 35 includes a cleaning brush and a cleaning blade that contact an outer circumferential surface of the intermediate transfer belt 30.

A toner receptacle 2 is disposed in an upper portion of the housing 100 of the image forming apparatus 1. The toner receptacle 2 accommodates four removable toner bottles 2Y, 2C, 2M, and 2K that contain toner of the colors yellow, cyan, magenta, and black, respectively. Toner supply tubes are interposed between the toner bottles 2Y, 2C, 2M, and 2K and the respective developing devices 7. The fresh toner is supplied from the toner bottles 2Y, 2C, 2M, and 2K to the respective developing devices 7 through the toner supply tubes.

In a lower portion of the housing 100 of the image forming apparatus 1 are, e.g., a sheet tray 10 and a sheet feeding roller 11. The sheet tray 10 accommodates a plurality of sheets P as recording media. The sheet feeding roller 11 picks up and feeds the plurality of sheets P one at a time from the sheet tray 10 toward the secondary transfer nip formed between the secondary transfer roller 36 and the intermediate transfer belt 30. The sheets P as recording media may be plain paper, thick paper, postcards, envelopes, thin paper, coated paper, art paper, tracing paper, overhead projector (OHP) transparencies, and the like. Optionally, the image forming, apparatus 1 may include a bypass feeder that imports such recording media placed on a bypass tray into the image forming apparatus 1.

In the housing 100 of the image forming apparatus 1 is a conveyance passage R defined by internal components of the image forming apparatus 1. Along the conveyance passage R, the sheet P is conveyed from the sheet tray 10 to a sheet ejection roller pair 13 via the secondary transfer nip. The sheet ejection roller pair 13 ejects the sheet P outside the housing 100 of the image forming apparatus 1.

Along the conveyance passage R are, e.g., a registration roller pair 12, a fixing device 20, and the sheet ejection roller pair 13. The registration roller pair 12 is disposed upstream from the secondary transfer roller 36 in a direction of sheet conveyance A1 as a direction of recording medium conveyance. The registration roller pair 12, as a conveyance device, conveys the sheet P to the secondary transfer nip.

The fixing device 20 is disposed downstream from the secondary transfer roller 30 in the direction of sheet conveyance A1. The fixing device 20 receives the sheet P bearing a toner image and fixes the toner image onto the sheet P. The sheet ejection roller pair 13 is disposed downstream from the fixing device 20 in the direction of sheet conveyance A1. The sheet ejection roller pair 13 ejects the sheet P onto an output tray 14. The output tray 14 is disposed atop the housing 100 of the image forming apparatus 1. The plurality of sheets P ejected by the sheet ejection roller pair 13 rests on the output tray 14 one by one.

In order to provide a fuller understanding of embodiments of the present disclosure, a description is now given of an image forming operation of the image forming apparatus 1 with continued reference to FIG. 1.

When a print job starts, a driver drives and rotates the photoconductor 5 of each of the image forming devices 4Y, 4C, 4M, and 4K in a clockwise direction of rotation R2 as illustrated in FIG. 1. The charger 6 uniformly charges the surface of the photoconductor 5 to a predetermined polarity. The exposure device 9 irradiates the charged surface of the photoconductor 5 with a laser beam to form an electrostatic latent image on the surface of the photoconductor 5 according to image data. It is to be noted that the image data is single-color image data obtained by separating a desired full-color image into individual color components, that is, yellow, cyan, magenta, and black components. The developing device 7 supplies toner to the electrostatic latent image thus formed on the surface of the photoconductor 5 to render the electrostatic latent image visible as a toner image.

Meanwhile, when the print job starts, the secondary transfer backup roller 32 is rotated counterclockwise in FIG. 1 to rotate the intermediate transfer belt 30 in the direction of rotation R1. The power supply applies a constant voltage or constant current control voltage having a polarity opposite a polarity of the toner to each of the primary transfer rollers 31. Accordingly, a transfer electric field is generated at each of the primary transfer nips between the primary transfer rollers 31 and the respective photoconductors 5.

When the toner image formed on the photoconductor 5 reaches the primary transfer nip in accordance with rotation of the photoconductor 5, the transfer electric field thus generated transfers the toner image from the photoconductor 5 onto the intermediate transfer belt 30. Specifically, toner images of yellow, cyan, magenta, and black are superimposed one atop another while being transferred onto the intermediate transfer belt 30. Thus, a full-color toner image is formed on the surface of the intermediate transfer belt 30. After the primary transfer of the yellow, cyan, magenta, and black toner images from the photoconductors 5 onto the intermediate transfer belt 30, the cleaners 8 remove residual toner, which has failed to be transferred onto the intermediate transfer belt 30 and therefore remaining on the photoconductors 5, from the photoconductors 5, respectively. Then, a discharger discharges the surface of the photoconductor 5 to initialize the surface potential of the photoconductor 5.

In the lower portion of the image forming apparatus 1, the sheet feeding roller 11 starts rotation to feed the sheet P from the sheet tray 10 toward the registration roller pair 12 along the conveyance passage R. The activation of the registration roller pair 12 is timed to convey the sheet P to the secondary transfer nip between the secondary transfer roller 36 and the intermediate transfer belt 30 so that the sheet P meets the full-color toner image formed on the surface of the intermediate transfer belt 30 at the secondary transfer nip. The secondary transfer roller 36 is supplied with a transfer voltage having a polarity opposite a polarity of the charged toner contained in the full-color toner image formed on the intermediate transfer belt 30, thereby generating a transfer electric field at the secondary transfer nip.

When the full-color toner image formed on the intermediate transfer belt 30 reaches the secondary transfer nip in accordance with rotation of the intermediate transfer belt 30, the transfer electric field thus generated transfers the tones images of yellow, cyan, magenta, and black constructing the full-color toner image from the intermediate transfer belt 30 onto the sheet P collectively. The belt cleaner 35 removes residual toner, which has failed to be transferred onto the sheet P and therefore remaining on the intermediate transfer belt 30, from the intermediate transfer belt 30. The removed toner is conveyed and collected into the waste toner container disposed in the housing 100 of the image forming apparatus 1.

The sheet P bearing the full-color toner image is conveyed to the fixing device 20 that fixes the full-color toner image on the sheet P. Then, the sheet P bearing the fixed full-color toner image is conveyed to the sheet ejection roller pair 13 that ejects the sheet P onto the output tray 14 atop the image forming apparatus 1. Thus, the plurality of sheets P rests on the output tray 14.

As described above, the image forming apparatus 1 forms a full-color image on a recording medium. Alternatively, the image forming apparatus 1 may use one of the image forming devices 4Y, 4C, 4M, and 4K to form a monochrome image, or may use two or three of the image forming devices 4Y, 4C, 4M, and 4K to form a bicolor or tricolor image, respectively.

Figure 2:
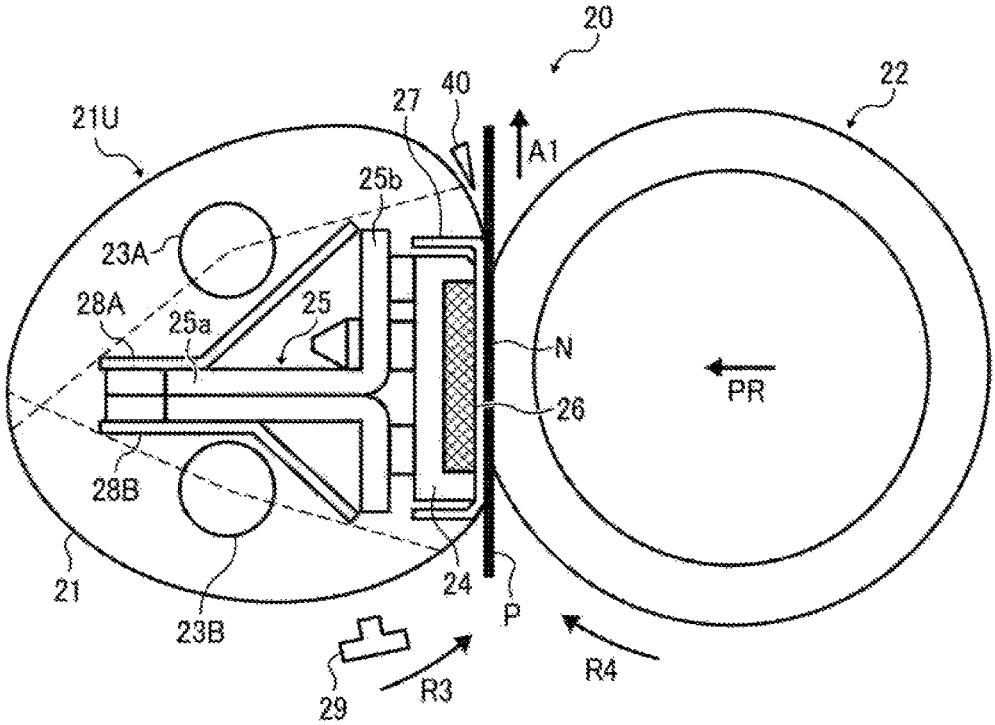
FIG. 2 is a schematic cross-sectional view of a fixing device incorporated in the image forming apparatus of FIG. 1.

Referring now to FIG. 2, a description is given of a construction of the fixing device 20 incorporated in the image forming apparatus 1 described above.

FIG. 2 is a schematic cross-sectional view of the fixing device 20.

The fixing device 20 (e.g., a fuser or a fuser unit) includes a fixing belt 21 formed into a loop, a pressure roller 22, a temperature sensor 29, a separator 40, and various components disposed inside the loop formed by the fixing belt 21, such as a plurality of heaters 23, a nip formation pad 24, a stay 25, a plurality of lateral end heaters 26, a thermal conduction aid 27, and a plurality of reflectors 28. The fixing belt 21 and the components disposed inside the loop formed by the fixing belt 21 constitute a belt unit 21U, detachably coupled to the pressure roller 22. The fixing belt 21 is an endless belt that is a thin, flexible, tubular fixing rotator rotatable in a counter-clockwise direction of rotation R3 as illustrated in FIG. 2. The pressure roller 22 is a pressure rotator that contacts an outer circumferential surface of the fixing belt 21 at an area of contact herein referred to as a fixing nip N. The pressure roller 22 is rotatable in a clockwise direction of rotation R4 as illustrated in FIG. 2. Inside the loop formed by the fixing belt 21 are the plurality of heaters 23, the nip formation pad 24, the stay 25, the plurality of lateral end heaters 26, the thermal conduction aid 27, and the plurality of reflectors 28. The plurality of heaters 23 radiates heat to heat the fixing belt 21. The plurality of heaters 23 includes heaters 23A and 23B as fixing heaters. In the present embodiment, the heaters 23A and 23B are halogen heaters. Alternatively, the heaters 23A and 23B may be induction heaters, resistive heat generators, carbon heaters, or the like.

The nip formation pad 24 is a pressure pad that extends in a longitudinal direction thereof parallel to an axial direction of the fixing belt 21. The nip formation pad 24 presses against the pressure roller 22 via the fixing belt 21, thereby forming the fixing nip N between the fixing belt 21 and the pressure roller 22. The stay 25 is a support that supports the nip formation pad 24. Specifically, the stay 25 secures and supports the nip formation pad 24 against the pressure roller 22. Accordingly, even when the nip formation pad 24 receives pressure from the pressure roller 22, the stay 25 prevents the nip formation pad 24 from being bent by such pressure, thereby maintaining a uniform width of the fixing nip N across an axial direction of the pressure roller 22, that is, a longitudinal direction of the pressure roller 22.

Figure 3:
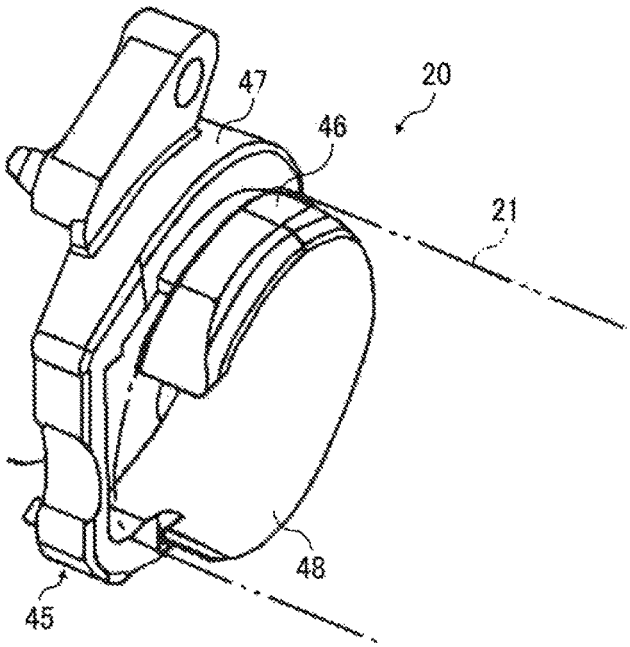
FIG. 3 is a schematic perspective view of a lateral end of the fixing device of FIG. 2.

The nip formation pad 24 is made of a heat-resistant material heatproof up to 200° C. and having good mechanical strength. More specifically, the nip formation pad 24 is made of heat-resistant resin such as polyimide (PI) resin, polyether ether ketone (PEEK) resin, and fiberglass-reinforced PI and PEEK. Thus, the nip formation pad 24 is immune to thermal deformation at temperatures in a fixing temperature range desirable to fix a toner image on a sheet P, thereby retaining the shape of the fixing nip N and quality of the toner image formed on the sheet P. Opposed lateral ends of the stay 25 and opposed lateral ends of the heaters 23A and 23B in a longitudinal direction thereof are secured to and supported by a pair of side plates of the fixing device 20 or a pair of holders provided separately from the pair of side plates. The plurality of lateral end heaters 26 is provided separately from the main heaters or fixing heaters (i.e., heaters 23A and 23B). The plurality of lateral end heaters 26 includes lateral end heaters 26*a* and 26*b* as illustrated in FIG. 3. The lateral end heaters 26*a* and 26*b* are mounted on or coupled to opposed lateral ends of the nip formation pad 24 in the longitudinal direction thereof, respectively. In the present embodiment, the plurality of lateral end heaters 26 is a contact-type, heat-transfer heater such as a ceramic heater.

The thermal conduction aid 27 is a thermal equalizer that facilitates heat transfer in the axial direction of the fixing belt 21. The thermal conduction aid 27 covers a nip-side face of each of the nip formation pad 24 and the plurality of lateral end heaters 26 disposed opposite an inner circumferential surface of the fixing belt 21. The thermal conduction aid 27 is made of a material that conducts heat quickly and well, such as copper or aluminum. Accordingly, the thermal conduction aid 27 conducts and equalizes heat in a longitudinal direction thereof parallel to the axial direction of the fixing belt 21, preventing heat from being stored at opposed lateral ends of the fixing belt 21 in the axial direction thereof while a plurality of small sheets P is conveyed over the fixing belt 21 or while the plurality of lateral end heater 26 is turned on. Thus, the thermal conduction aid 27 eliminates uneven heating of the fixing belt 21 in the axial direction thereof. The thermal conduction aid 27 includes a nip-side face 27*a* being disposed opposite and in direct contact with the inner circumferential surface of the fixing belt 21. Thus, the nip-side face 27*a* serves as a nip formation face. As illustrated in FIG. 2, the nip-side face 27*a* is flattened. Alternatively, the nip-side face 27*a* may be given a concave shape or another suitable shape. For example, a concave nip formation face directs a leading edge of the sheet P toward the pressure roller 22 as the sheet P is ejected from the fixing nip N, thereby facilitating separation of the sheet P from the fixing belt 21 and preventing a paper jam.

The temperature sensor 29 is disposed opposite the outer circumferential surface of the fixing belt 21, that is, outside the loop formed by the fixing belt 21. For example, as illustrated in FIG. 2, the temperature sensor 29 is disposed upstream from the fixing nip N in the direction of rotation R3 of the fixing belt 21. The temperature sensor 29 detects the temperature of the fixing belt 21. The separator 40 is disposed downstream from the fixing nip N in the direction of sheet conveyance A1 to separate the sheet P from the fixing belt 21. A biasing assembly presses the pressure roller 22 against the nip formation pad 24 via the fixing belt 21 and releases pressure exerted by the pressure roller 22 on the fixing belt 21.

The fixing belt 21 is an endless belt that is thin like a film and forms a loop of reduced diameter to reduce thermal capacity. Specifically, the fixing belt 21 is constructed of a base layer and a release layer coating the base layer. That is, the base layer and the release layer serve as the inner and outer circumferential surfaces of the fixing belt 21, respectively. The base layer is made of a metal material, such as nickel and stainless steel (e.g., steel use stainless or SUS), or a resin material such as polyimide. The release layer is made of e.g., tetrafluoroethylene-perfluoroalkyl vinyl ether copolymer (PFA) or polytetrafluoroethylene (PTFE). Optionally, an elastic layer made of rubber such as silicone rubber, silicone rubber foam, and fluoro rubber may be interposed between the base layer and the release layer. While the fixing belt 21 and the pressure roller 22 pressingly sandwich the unfixed toner image on the sheet P to fix the toner image on the sheet P, the elastic layer having a thickness of about 100 μm elastically deforms to absorb slight surface asperities in the fixing belt 21, preventing variation in gloss of the toner image on the sheet P. In order to reduce thermal capacity, the fixing belt 21 has a total thickness not greater than 1 mm and a loop diameter in a range of from 20 mm to 40 mm. Specifically, for example, the base layer has a thickness in a range of from 20 μm to 50 μm. The elastic layer has a thickness in a range of from 100 μm to 300 μm. The release layer has a thickness in a range of from 10 μm to 50 μm. In order to further reduce thermal capacity, preferably, the fixing belt 21 may have a total thickness not greater than 0.2 mm, and more preferably, not greater than 0.16 mm while having a loop diameter not greater than 30 mm.

The stay 25, having a T-shaped cross-section, includes an arm 25*a* and a base 25*b* disposed opposite the fixing nip N. The arm 25*a* projects from the base 25*b* away from the fixing nip N in a direction of biasing PR in which the pressure roller 22 presses against the nip formation pad 24 via the fixing belt 21. The arm 25*a* is interposed between the heaters 23A and 23B (i.e., fixing heaters) to separate the heaters 23A and 23B from each other. One of the healers 23A and 23B includes a center heat generator spanning a center of one of the heaters 23A and 23B in the longitudinal direction thereof to heat toner images on small sheets P passing through the fixing nip N. The other one of the heaters 23A and 23B includes a lateral end heat generator spanning each lateral end of the other one of the heater 23A and 23B in the longitudinal direction thereof to heat toner images on large sheets P passing through the fixing nip N. The power supply situated inside the image forming apparatus 1 supplies power to the heaters 23A and 23B so that the heaters 23A and 23B generate heat. A controller, operatively connected to the heaters 23A and 23B and the temperature sensor 29, controls the heaters 23A and 23B based on the temperature of the outer circumferential surface of the fixing belt 21, which is detected by the temperature sensor 29 disposed opposite the outer circumferential surface of the fixing belt 21. Thus, the temperature of the fixing belt 21 is adjusted to a desired fixing temperature.

The plurality of reflectors 28 includes reflectors 28A and 28B. The reflector 28A is interposed between the healer 23A and the stay 25. The reflector 28B is interposed between the healer 23B and the stay 25. In such a construction, the reflectors 28A and 28B reflect light and heat radiating from the heaters 23A and 23B, respectively, toward the fixing belt 21, thus enhancing heating efficiency of the heaters 23A and 23B to heat the fixing belt 21. In addition, the reflectors 28A and 28B prevent light and heat radiating from the heaters 23A and 23B from heating the stay 25, suppressing waste of energy. Alternatively, instead of the reflectors 28A and 28B, a heater-side face of the stay 25 disposed opposite the heaters 23A and 23B may be insulated or given a mirror finish to reflect light and heat radiating from the heaters 23A and 23B toward the fixing belt 21.

The pressure roller 22 is constructed of a core, an elastic layer coating the core, and a release layer coating the elastic layer. The elastic layer is made of rubber such as silicone rubber form and fluororubber. The release layer is made of, e.g., PFA or PTFE to facilitate separation of the sheet P from the pressure roller 22. As the pressure roller 22 is pressed against the fixing belt 21 by, e.g., a spring, the elastic layer of the pressure roller 22 is deformed, forming an area of contact (i.e., fixing nip N) having a predetermined width between the fixing belt 21 and the pressure roller 22. In the present embodiment, a driver such as a motor disposed inside the image forming apparatus 1 drives and rotates the pressure roller 22 in the direction of rotation R4. As the driver drives and rotates the pressure roller 22, a driving force of the driver is transmitted from the pressure roller 22 to the fixing belt 21 at the fixing nip N, thereby rotating the fixing belt 21 in the direction of rotation R3. While the fixing belt 21 rotates, a nip span of the fixing belt 21 located at the fixing nip N is sandwiched between the pressure roller 22 and the nip formation pad 24. On the other hand, a circumferential span of the fixing belt 21 other than the nip span is guided by flanges secured to the pair of side plates at the opposed lateral ends of the fixing belt 21 in the axial direction thereof.

In the present embodiment, the pressure roller 22 is a solid roller. Alternatively, the pressure roller 22 may be a hollow roller, i.e., a tube. If the pressure roller 22 is a hollow roller, optionally, a heater such as a halogen heater may be disposed inside the pressure roller 22. The elastic layer of the pressure roller 22 may be made of solid rubber. Alternatively, if no heater is situated inside the pressure roller 22, the elastic layer of the pressure roller 22 may be made of sponge rubber. The sponge rubber is preferable to the solid rubber because the sponge rubber has enhanced thermal insulation that draws less heat from the fixing belt 21.

Referring now to FIG. 3, a description is given of a construction of the fixing device 20.

FIG. 3 is a schematic perspective view of a lateral end of the fixing device 20.

Flanges 45 are disposed at the opposed lateral ends of the fixing belt 21 in the axial direction thereof. FIG. 3 illustrates the flange 45 disposed at one of the opposed lateral ends of the fixing belt 21 in the axial direction thereof.

The flange 45 is hollow and open at each lateral end in an axial direction thereof parallel to the axial direction of the fixing belt 21. The flange 45 includes a receiver 46 extending in the axial direction thereof and a flange portion 47 projecting from the receiver 46 in a radial direction and being molded with the receiver 46. The receiver 46 is partially cylindrical or tubular, including a slit 48 in a partial circumferential span thereof. The nip formation pad 24 and the thermal conduction aid 27 are inserted into the space defined by the slit 48.

If the fixing belt 21 is moved or skewed in the axial direction thereof in accordance with rotation of the fixing belt 21, the lateral end of the fixing belt 21 comes into contact with the receiver 46 to restrict motion of the fixing belt 21 in the axial direction thereof. The flange portion 47 is secured to the side plate of the fixing device 20. Optionally, a ring plate made of a material with good sliding property may be interposed between the receiver 46 and the lateral end of the fixing belt 21 in the axial direction thereof.

Figure 4:
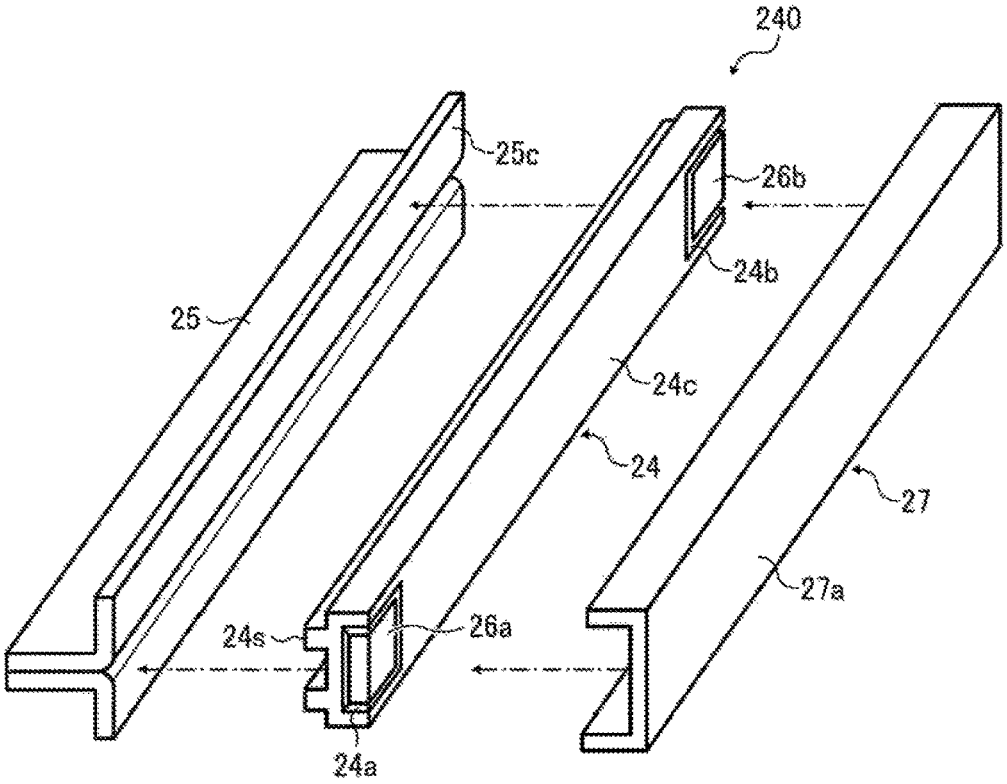
FIG. 4 is an exploded perspective view of a nip formation unit incorporated in the fixing device of FIG. 2, illustrating a nip formation pad, a stay, end heaters, and a thermal conduction aid that construct the nip formation unit.

Referring now to FIG. 4, a description is given of a construction of a nip formation unit 24 incorporated in the fixing device 20 described above.

FIG. 4 is an exploded perspective view of the nip formation unit 240, illustrating the nip formation pad 24, the stay 25, the lateral end heaters 26*a* and 26*b*, and the thermal conduction aid 27 that construct the nip formation unit 240.

As illustrated in FIG. 2, the thermal conduction aid 27 is disposed between the nip formation pad 24 and the fixing belt 21. The thermal conduction aid 27 engages the nip formation pad 24 given an approximately rectangular shape such that the thermal conduction aid 27 covers a nip-side face 24*c* of the nip formation pad 24 that is disposed opposite the inner circumferential surface of the fixing belt 21. Thus, the thermal conduction aid 27 is coupled to the nip formation pad 24 in the present embodiment, the thermal conduction aid 27 engages the nip formation pad 24 with, e.g., a projection. Alternatively, the thermal conduction aid 27 may be attached to the nip formation pad 24 with, e.g., an adhesive. The nip formation pad 24 includes two recesses 24*a* and 24*b*, which define a difference in thickness of the nip formation pad 24, at the opposed lateral ends of the nip formation pad 24 in the longitudinal direction thereof. The lateral end heaters 26*a* and 26*b* are accommodated by and secured to the recesses 24*a* and 24*b*, respectively. As described above, the thermal conduction aid 27 includes the nip-side face 27*a* that is disposed opposite the inner circumferential surface of the fixing belt 21. In addition to the nip-side face 24*c* facing the fixing nip N, the nip formation pad 24 includes a stay-side face 24*s* being opposite the nip-side face 24*c* and facing the stay 25. The stay 25 includes a nip-side face 25*c* facing the fixing nip N. The nip-side face 25*c* of the stay 25 contacts and supports the stay-side face 24*s* of the nip formation pad 24. Preferably, the stay-side face 24*s* of the nip formation pad 24 and the nip-side face 25*c* of the stay 25 may mount a recess and a projection (e.g., a boss and a pin), respectively, to reduce a contact area between the nip formation pad 24 and the stay 25.

Typical fixing devices often include an endless belt in the form of a strip of film to reduce thermal capacity. In order to enhance heat efficiency, a heat directly heat the endless belt. However, the temperature of the endless belt may become uneven when a sheet as a recording medium bearing a toner image is conveyed between the endless belt and a pressure roller pressed against the endless belt.

Specifically, when a small sheet is conveyed between the endless belt and the pressure roller, the small sheet is conveyed over the endless belt and draws heat therefrom. However, in a non-conveyance span of the endless belt where the small sheet is not conveyed over the endless belt, the heat is not drawn from the endless belt. Therefore, the endless belt and the pressure roller store heat. As a consequence, the temperature of the non-conveyance span of the endless belt may become higher than the temperature of a conveyance-span of the endless belt where the small sheet is conveyed over the endless belt, which is maintained at a predetermined temperature. In addition, the typical fixing devices often include a nip formation pad that forms the fixing nip together with the pressure roller. The nip formation pad often has a low thermal conductivity, facilitating the endless belt and the pressure roller to store heat. As a consequence, the image may be improperly fixed onto the sheet, resulting in image unevenness. In addition, the surface layer of the endless belt and the pressure roller may be prematurely degraded.

Hence, according to the embodiments of the present disclosure, the fixing device 20 includes the thermal conduction aid 27, thereby eliminating uneven heating of the fixing belt 21 in the axial direction thereof while a sheet P bearing a toner image is conveyed through the fixing device 20. However, when heat is transferred from the fixing belt 21 to the thermal conduction aid 27, the heat is further transferred to the nip formation pad 24. The heat transferred from the thermal conduction aid 27 to the nip formation pad 24 is waste energy that does not contribute to the fixing operation, serving instead merely to increase consumption of power used for the fixing operation.

Hence, according to the embodiments of the present disclosure, heat transfer from the thermal conduction aid 27 to the nip formation pad 24 is suppressed to reduce such waste energy that does not contribute to the fixing operation and to reduce power consumption, thereby enhancing energy efficiency of the fixing device 20 and further enhancing energy efficiency of the image forming apparatus 1 overall.

A description is now given of embodiments (i.e., structures) for reducing the waste energy that does not contribute to the fixing operation.

Initially with reference to FIG. 3, a description is given of a configuration of a nip formation pad 24X according to a first embodiment of the present disclosure.

Figure 5:
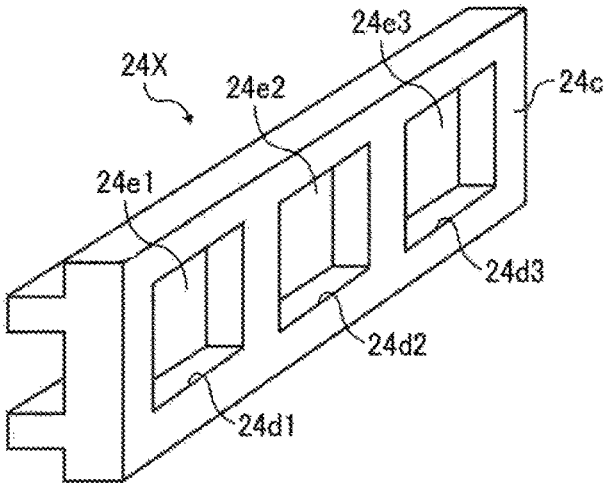
FIG. 5 is a perspective view of the nip formation pad according to a first embodiment of the present disclosure.

FIG. 5 is a perspective view of the nip formation pad 24X. For the sake of simplicity, the lateral end heaters 26*a* and 26*b* and the recesses 24*a* and 24*b* illustrated in FIG. 4 are omitted.

The nip formation pad 24X includes the nip-side face 24*c* that is disposed opposite the pressure roller 22. The nip-side face 24*c* includes three mouths 24*d*1, 24*d*2, and 24*d*3 arranged side by side in a longitudinal direction thereof. The mouths 24*d*1, 24*d*2, and 24*d*3 define openings 24*e*1, 24*e*2, and 24*e*3, respectively. The openings 24*e*1, 24*e*2, and 24*e*3 are non-contact areas in which the nip formation pad 24X does not contact the thermal conduction aid 27. Thus, the mouths 24*d*1, 24*d*2, and 24*d*3 reduces an actual contact area between the thermal conduction aid 27 and the nip formation pad 24X while providing an air layer therebetween. Accordingly, in the present embodiment, decreased heat is conducted from the thermal conduction aid 27 to the nip formation pad 24X. In addition, the relatively wide and deep mouths 24*d*1, 24*d*2, and 24*d*3 reduce the volume and thermal capacity of the nip formation pad 24X. Accordingly, the nip formation pad 24X suppresses heat transfer from the thermal conduction aid 27, which does not contribute to the fixing operation, thereby reducing overall power consumption of the fixing device 20.

A description is now given of advantages of the first embodiment (i.e., structure) described above from another viewpoint. As described above, the thermal conduction aid 27 conducts heat in the longitudinal direction thereof. In addition, the thermal conduction aid 27 conducts heat in a direction toward the nip formation pad 24X. Since the nip formation pad 24X has a decreased thermal conductivity, the heat is conducted in the longitudinal direction of the thermal conduction aid 27 rather than the direction toward the nip formation pad 24X. Accordingly, the nip formation pad 24X further enhances heat equalization of the thermal conduction aid 27.

Figure 6A:
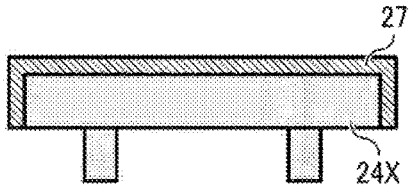
FIG. 6A is a cross-sectional view of the thermal conduction aid and the nip formation pad of FIG. 5 at a position where an opening does not exist.
Figure 6B:
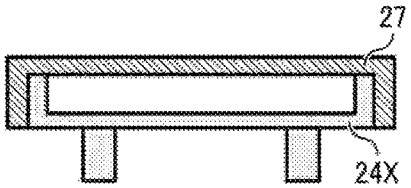
FIG. 6B is a cross-sectional view of the thermal conduction aid and the nip formation pad of FIG. 5 at a position where the opening exists.

FIG. 6A is a cross-sectional view of the thermal conduction aid 27 and the nip formation pad 24X at a position where none of the openings 24*e*1, 24*e*2, and 24*e*3 exists. FIG. 6B is a cross-sectional view of the thermal conduction aid 27 and the nip formation pad 24X at a position where any one of the openings 24*e*1, 24*e*2, and 24*e*3 exists.

Heat transfer from the fixing belt 21 toward the sheet P and the nip formation pad 24X where the mouths 24*d*1, 24*d*2, and 24*d*3 of the nip formation pad 24X exist in the longitudinal direction thereof is different from heat transfer from the fixing belt 21 toward the sheet P and the nip formation pad 24X elsewhere in the longitudinal direction the nip formation pad 24X.

In addition, the fixing nip N is supported by the nip formation pad 24X at the positions without the mouths 24*d*1, 24*d*2, or 24*d*3 in the axial direction of the fixing belt 21. On the other hand, the fixing nip N is supported by the thermal conduction aid 27 at the positions with the mouths 24*d*1, 24*d*2, and 24*d*3 in the axial direction of the fixing belt 21. Since the nip formation pad 24X and the thermal conduction aid 27 differ in rigidity, the fixing nip N has different pressure conditions in the axial direction of the fixing belt 21 and the pressure roller 22. As a consequence, the toner image may be fixed onto the sheet P with variation in gloss. In order to address this circumstance, a nip formation pad 24Y illustrated in FIG. 7 is provided.

Figure 7:
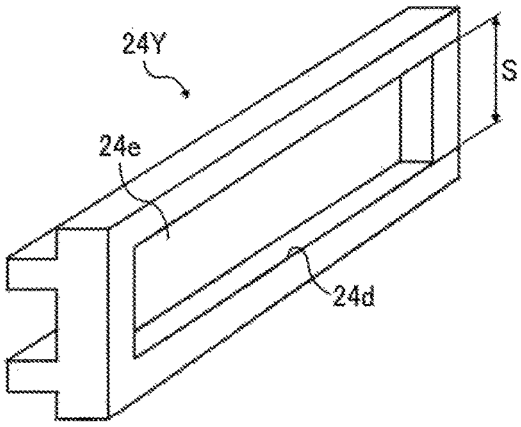
FIG. 7 is a perspective view of the nip formation pad according to a second embodiment of the present disclosure.

Referring now to FIG. 7, a description is given of a configuration of the nip formation pad 24Y according to a second embodiment of the present disclosure.

FIG. 7 is a perspective view of the nip formation pad 24Y.

Unlike the nip formation pad 24X that includes the three mouths 24*d*1, 24*d*2, and 24*d*3 in the longitudinal direction thereof, the nip formation pad 24Y includes a single mouth 24*d* that defines an opening 24*e* as a non-contact area in which the nip formation pad 24Y does not contact the thermal conduction aid 27. The mouth 24*d* has a length S in a short direction of the nip formation pad 24Y. The length S remains unchanged over a given length in a longitudinal direction of the nip formation pad 24Y. That is, the mouth 24*d* has a continuous, identical width over the given length in the longitudinal direction of the nip formation pad 24Y. Therefore, the nip formation pad 24Y has an identical cross-section at any position in the longitudinal direction thereof. As a consequence, the toner image is properly fixed onto the sheet P, without variation in gloss. Since the thermal conduction aid 27 supports the pressure from the pressure roller 22, the size and the shape of the mouth 24*d* is determined taking into account a deflection amount of the thermal conduction aid 27.

Figure 8:
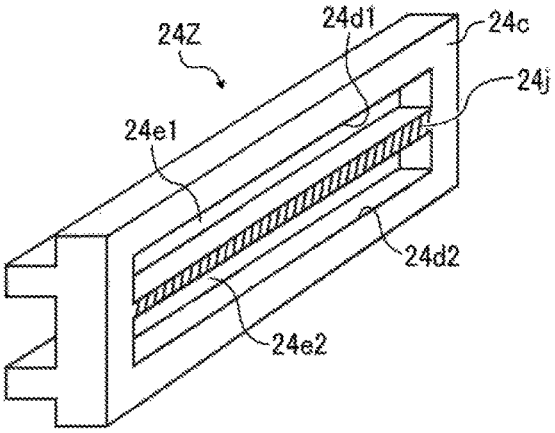
FIG. 8 is a perspective view of the nip formation pad according to a third embodiment of the present disclosure.

Referring now to FIG. 8, a description is given of a configuration of a nip formation pad 24Z according to a third embodiment of the present disclosure.

FIG. 8 is a perspective view of the nip formation pad 24Z.

Unlike the nip formation pad 24X that includes the three mouths 24*d*1, 24*d*2, and 24*d*3 in the longitudinal direction thereof, and unlike the nip formation pad 24Y that includes the single mouth 24*d*, the nip formation pad 24Z includes two mouths 24*d*1 and 24*d*2 arranged side by side in a short direction of the nip formation pad 24Z. The mouths 24*d*1 and 24*d*2 define the openings 24*e*1 and 24*e*2, respectively. The openings 24*e*1 and 24*e*2 are non-contact areas in which the nip formation pad 24Z does not contact the thermal conduction aid 27. In addition, the nip formation pad 24Z includes a contact area 24*j*, illustrated as a hatched area in FIG. 8, in the short direction of the nip formation pad 24Z. In the contact area 24*j*, the nip formation pad 24Z contacts the thermal conduction aid 27. The nip formation pad 24Z has an identical cross-section at any position in a longitudinal direction thereof. As a consequence, the toner image is properly fixed onto the sheet P, without variation in gloss. Since the contact area 24*j* supports the thermal conduction aid 27, the thermal conduction aid 27 deflects in a significantly less amount than the deflection amount of the thermal conduction aid 27 in the second embodiment described above.

If the nip-side face 24*c* is flat, the nip-side face 24*c* is subjected to a maximum pressure from the pressure roller 22 at an intersection of the nip-side face 24*c* and a line extending perpendicularly to the nip-side face 24*c* from a center position of the pressure roller 22 toward the nip-side face 24*c*. The mouths 24*d*1 and 24*d*2 define the contact area 24*j* therebetween such that the contact area 24*j* includes the intersection, thereby further reducing the deflection amount of the thermal conduction aid 27. Even if the nip-side face 24*c* is rough, the deflection amount of the thermal conduction aid 27 is reduced provided that the contact area 24*j* includes the position where the nip-side face 24*c* is subjected to the maximum pressure from the pressure roller 22.

Figure 9:
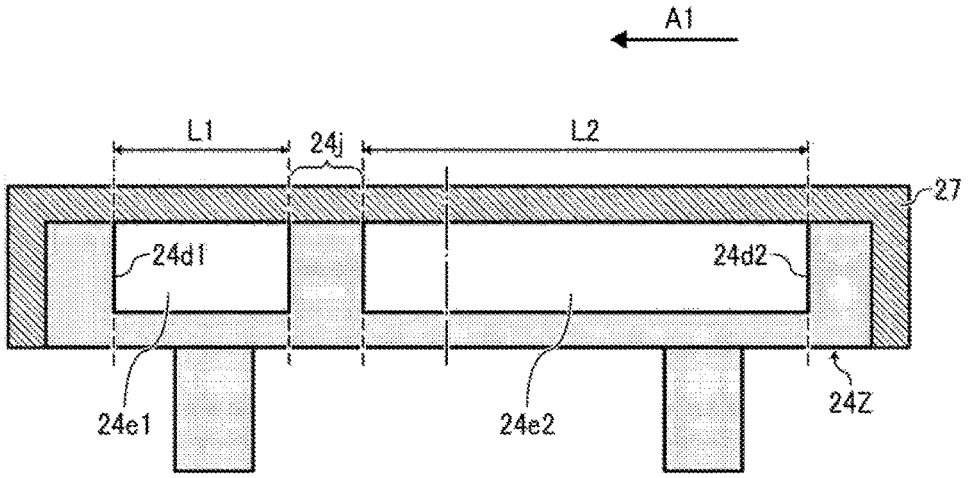
FIG. 9 is a cross-sectional view of the thermal conduction aid and an example of the nip formation pad according to the third embodiment in a short direction thereof, illustrating two openings of different sizes.

FIG. 9 is a cross-sectional view of the thermal conduction aid 27 and an example of the nip formation pad 24Z in the short direction thereof.

The nip formation pad 24Z of FIG. 9 includes the two openings 24*e*1 and 24*e*2 (i.e., non-contact area between the nip formation pad 24Z and the thermal conduction aid 27) defined by the two mouths 24*d*1 and 24*d*2, respectively, which differ from each other in size. Specifically, the mouth 24*d*1, which defines the opening 24*e*1, has a length L1 in the short direction of the nip formation pad 24Z. The mouth 24*d*2, which defines the opening 24*e*2, has a length L2 in the short direction of the nip formation pad 24Z. The length L1 of the mouth 24*d*1 is smaller than the length L2 of the mouth 24*d*2. The contact area 24*j* is defined between the mouths 24*d*1 and 24*d*2 such that the contact area 24*j* is disposed downstream in the direction of sheet conveyance A1. That is, the mouth 24*d*2 disposed upstream from the mouth 24*d*1 in the direction of sheet conveyance A1 defines the opening 24*e*2 larger than the opening 24*e*1 defined by the mouth 24*d*1. In this configuration, the nip-side face 24*c* is subjected to a lower surface pressure and has a higher thermal insulation upstream in the direction of sheet conveyance A1, than the surface pressure and the thermal insulation downstream in the direction of sheet conveyance A1. Accordingly, when the toner image is fixed onto the sheet P, toner contained in the toner image melts into liquid first. Then, the liquid toner is pressed against and fixed onto the sheet P. That is, the toner image is fixed on the sheet P at a decreased fixing temperature. The size and the number of the mouth 24*d* is determined such that the nip-side face 24*c* is subjected to a desired surface pressure as described above.

Figure 10:
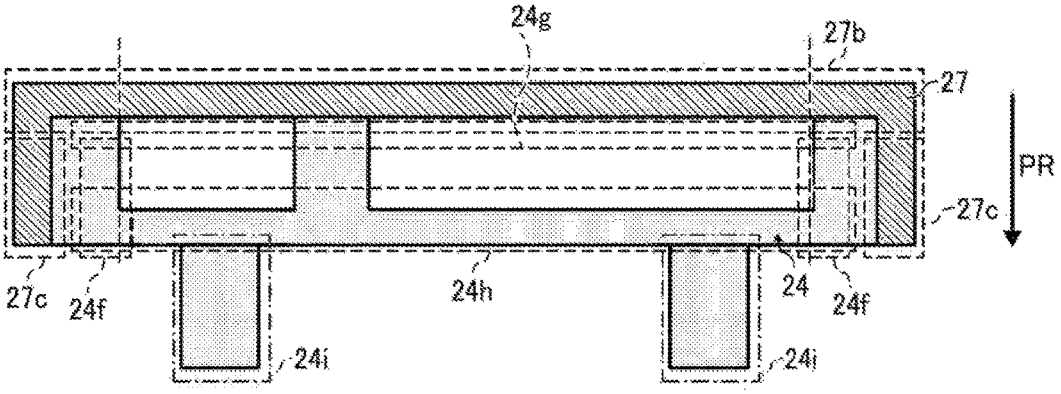
FIG. 10 is a cross-sectional view of the thermal conduction aid and the nip formation pad illustrating configurations thereof.

In order to fully understand a structure of the thermal conduction aid 27 and the nip formation pad 24, a detailed description is given of the configurations of the thermal conduction aid 27 and the nip formation pad 24 with reference to FIG. 10.

FIG. 10 is a cross-sectional view of the thermal conduction aid 27 and the nip formation pad 24, illustrating configurations thereof.

The thermal conduction aid 27 includes a base 27*b* and two projections 27*c*. The projections 27*c* project from opposed end portions of the base 27*b* toward the stay 25. The nip formation pad 24 includes projection-side portions 24*f*, a base-side portion 24*g*, a stay-side portion 24*h*, and projecting portions 24*i*. The projection-side portion 24*f* faces the projections 27*c* of the thermal conduction aid 27.

The base-side portion 24*g* defines a surface facing the base 27*b* of the thermal conduction aid 27. The stay-side portion 24*h* extends from a vicinity of an edge facing the stay 25 of one of the projections 27*c* to a vicinity of an edge facing the stay 25 of the other one of the projections 27*c*. Thus, the stay-side portion 24*h* defines a surface facing the stay 25. The stay-side portion 24*h* is substantially parallel to the base 27*b* of the thermal conduction aid 27. In FIG. 10, the stay-side portion 24*h* of the nip formation pad 24 and the edge of each of the projections 27*c* of the thermal conduction aid 27 are on an identical planar surface. Alternatively, one of the stay-side portion 24*h* and the edge of each of the projections 27*c* may be higher than the other one. In other words, the stay-side portion 24*h* and the edge of each of the projections 2*c* may define at least one step.

The projecting portions 24*i* project toward the stay 25 from the stay-side portion 24*h*. Each of the projecting portions 24*i* has an edge that contacts the stay 25. Alternatively, an interposer may be interposed between the stay 25 and the edge of each of the projecting portions 24*i*. Thus, the stay 25 and the projecting portions 24*i* may indirectly contact each other. The edge of each of the projecting portions 24*i* that contacts the stay 25 projects beyond the edge of the protections 27*c* of the thermal conduction aid 27 toward the stay 25, in the direction of biasing PR in which the pressure roller 22 exerts pressure. In other words, the stay 25 does not enter a recess defined by the base 27*b* and the projections 27*c* of the thermal conduction aid 27.

Figure 11A:
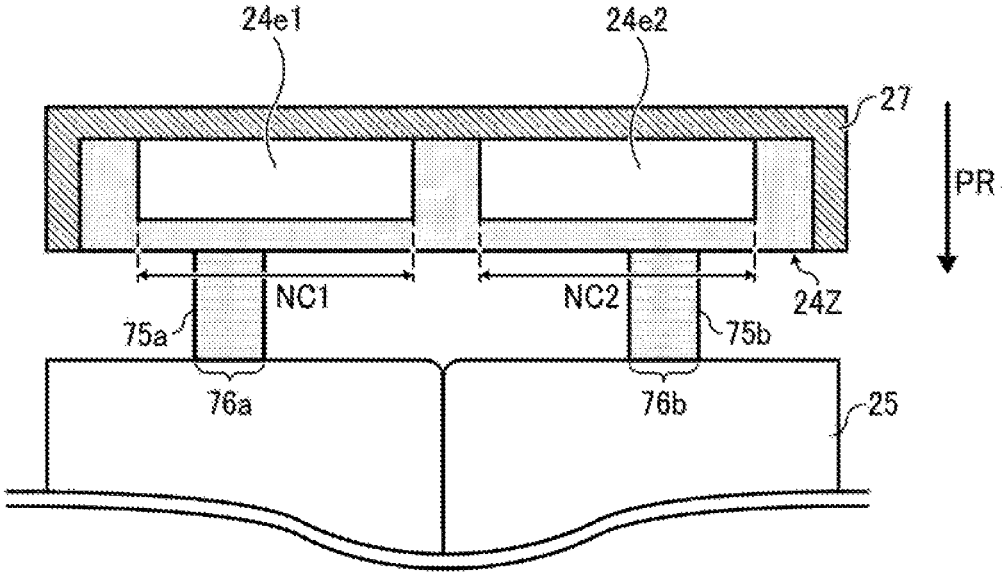
FIG. 11A is a cross-sectional view of the thermal conduction aid, the nip formation pad that includes convex contact portions, and the stay in a short direction thereof.
Figure 11B:
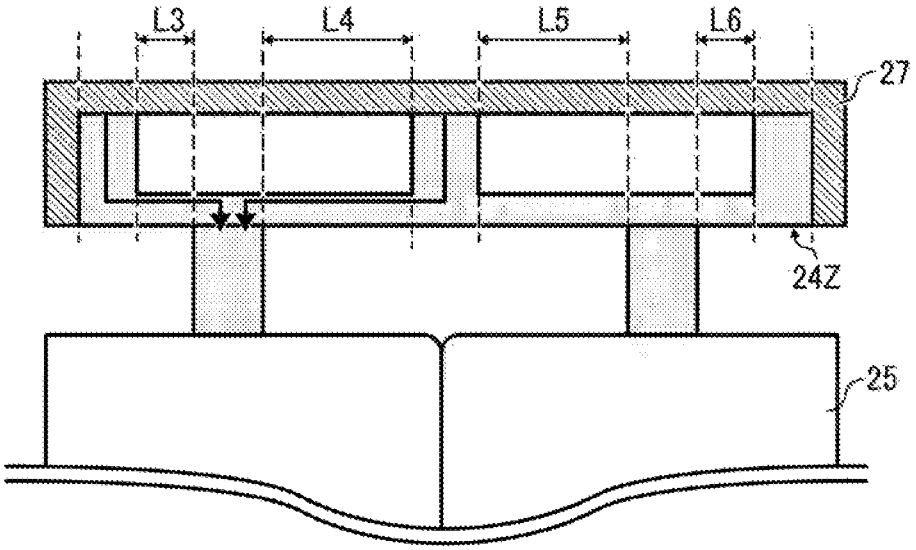
FIG. 11B is a cross-sectional view of the thermal conduction aid, the nip formation pad, and the stay in the short direction thereof, illustrating thermal conduction passages.

Referring now to FIGS. 11A and 11B, a description is given of how the nip formation pad 24Z and the stay 25 contact each other.

Figure 11C:
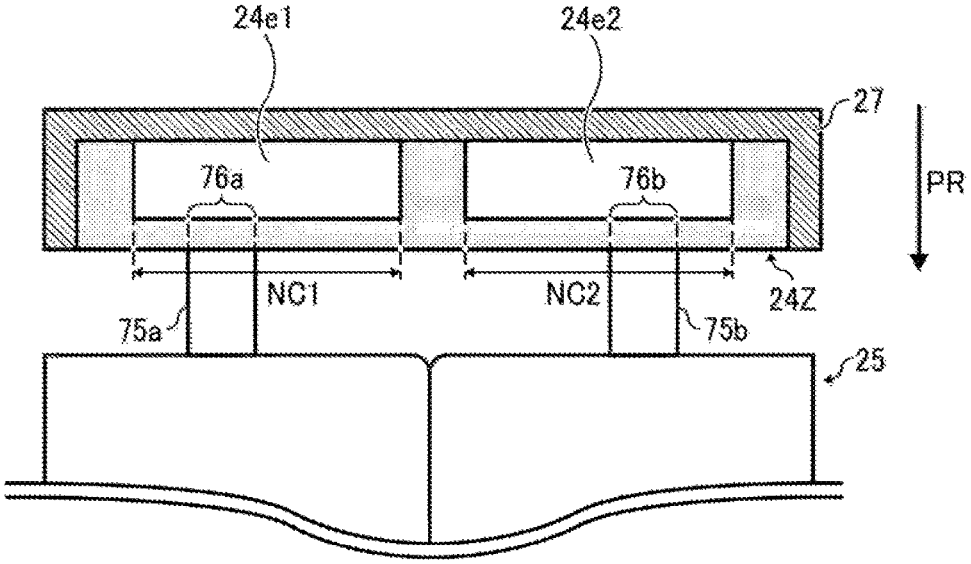
FIG. 11C is a cross-sectional view of the thermal conduction aid, the nip formation pad, and the stay that includes convex contact portions in the short direction thereof.

FIG. 11A is a cross-sectional view of the thermal conduction aid 27, the nip formation pad 24Z that includes convex contact portions 75*a* and 75*b*, and the stay 25 in a short direction thereof. FIG. 11B is a cross-sectional view of the thermal conduction aid 27, the nip formation pad 24Z, and the stay 25 in the short direction thereof, illustrating thermal conduction passages. FIG. 11C is a cross-sectional view of the thermal conduction aid, the nip formation pad, and the stay that includes the convex contact portions 75*a* and 75*b* in the short direction thereof.

As illustrated in FIG. 11A, the stay 25 supports the nip formation pad 24Z. Specifically, the stay 25 supports the nip formation pad 24Z through the convex contact portions 75*a* and 75*b* of the nip formation pad 24Z, which correspond to the projecting portions 24*i* illustrated in FIG. 10. The contact portions 75*a* and 75*b* contact the stay 25 in contact areas 76*a* and 76*b*, respectively. The contact areas 76*a* and 76*b* are in a range NC1 corresponding to the opening 24*e*1 and in a range NC2 corresponding to the opening 24*e*2, respectively, as seen from the nip-side face 24*c* of the nip formation pad 24Z in the direction of biasing PR perpendicular to the direction of sheet conveyance A1.

As illustrated in FIG. 11B, heat detours for distances L1 through L4 while passing through the nip formation pad 24Z from the thermal conduction aid 27 to reach the stay 25. Accordingly, the nip formation pad 24Z has enhanced thermal insulation to reduce heat that reaches the stay 25. In the present embodiment, the nip formation pad 24Z includes the convex contact portions 75*a* and 75*b*. Alternatively, the stay 25 may include the convex contact portions 75*a* and 75*b* as illustrated in FIG. 11C.

In order to support pressure from the pressure roller 22, some fixing devices may have difficulty in disposing the contact areas 76*a* and 76*b* between the stay 25 and the nip formation pad 24Z within the openings 24*e*1 and 24*e*2, respectively, as seen from the nip-side face 24*c* of the nip formation pad 24Z in the direction of biasing PR. The relative positions and the numbers of the mouths 24*d*1 and 24*d*2 and the contact area 24*j* may be determined such that the contact areas 76*a* and 76*b* between the stay 25 and the nip formation pad 24Z are within the openings 24*e*1 and 24*e*2, respectively, as seen from the nip-side face 24*c* of the nip formation pad 24Z in the direction of biasing PR. In the present embodiment, the nip formation pad 24Z includes the two convex contact portions 75*a* and 75*b*. Alternatively, there may be a single convex contact portion 75 or two or more convex contact portions 75.

Figure 12:
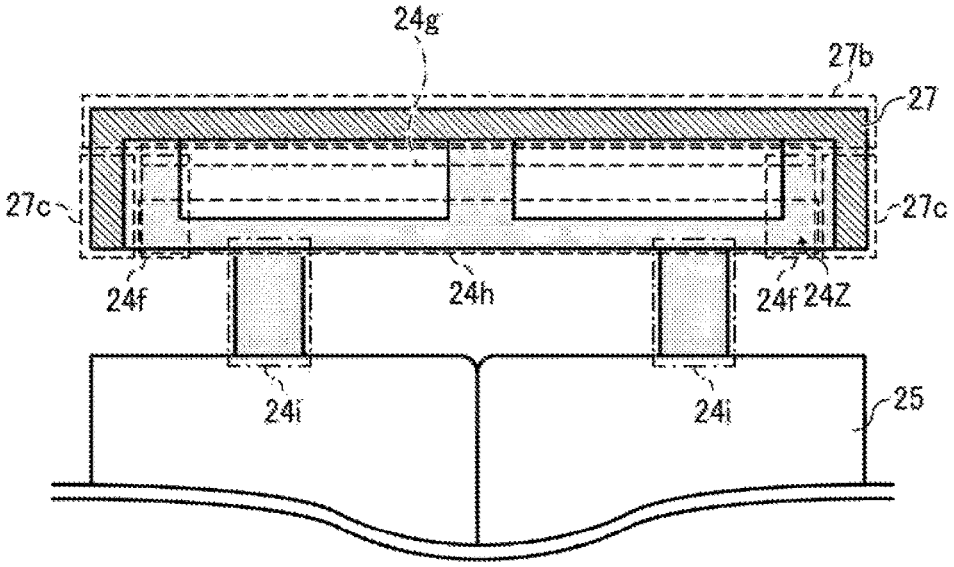
FIG. 12 is a cross-sectional view of the thermal conduction aid, the nip formation pad of FIG. 8, and the stay, illustrating configurations of the thermal conduction aid and the nip formation pad.

FIG. 12 is a cross-sectional view of the thermal conduction aid 27, the nip formation pad 24Z, and the stay 25, illustrating configurations of the thermal conduction aid 27 and the nip formation pad 24Z.

It is to be noted that identical reference numerals are assigned to portions of the thermal conduction aid 27 and the nip formation pad 24Z illustrated in FIG. 12 that are identical to the portions of the thermal conduction aid 27 and the nip formation pad 24 illustrated in FIG. 10. A description of the identical portions is herein omitted.

Figure 13:
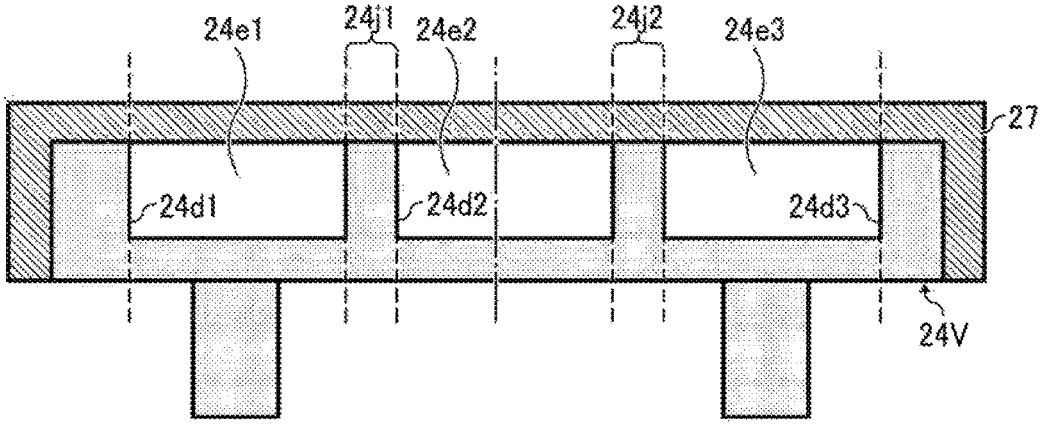
FIG. 13 is a cross-sectional view of the thermal conduction aid and a variation of the nip formation pad of FIG. 8 in a short direction thereof.

Referring now to FIG. 13, a description is given of a configuration of a nip formation pad 24V as a variation of the nip formation pad 24Z described above.

FIG. 13 is a cross-sectional view of the thermal conduction aid 27 and the nip formation pad 24V in a short direction thereof.

Unlike the nip formation pad 24Z that includes the two mouths 24*d*1 and 24*d*2 in the short direction thereof, the nip formation pad 24V includes the three mouths 24*d*1, 24*d*2, and 24*d*3 arranged side by side in the short direction thereof. The mouths 24*d*1, 24*d*2, and 24*d*3 define the openings 24*e*1, 24*e*2, and 24*e*3, respectively. The openings 24*e*1, 24*e*2, and 24*e*3 are non-contact areas in which the nip formation pad 24V does not contact the thermal conduction aid 27. In a center portion of the nip formation pad 24V, contact areas 24*j*1 and 24*j*2 are defined in which the nip formation pad 24V contacts the thermal conduction aid 27. Specifically, the contact area 24*j*1 is defined between the mouths 24*d*1 and 24*d*2. The contact area 24*j*2 is defined between the mouths 24*d*2 and 24*d*3. Thus, the nip formation pad 24V includes a plurality of mouths 24*d* arranged side by side in the short direction of the nip formation pad 24V. Since the nip formation pad 24V has an increased number of contact areas 24*j* bounded by the plurality of mouths 24*d*, the nip formation pad 24V reduces the deflection amount of the thermal conduction aid 27 compared to the nip formation pad 24Z illustrated in FIG. 8. On the other hand, increasing the number of the mouths 24*d* shortens the heat transfer passages from the thermal conduction aid 27 to the stay 25 through the nip formation pad 24V in the short direction thereof. In order to address this circumstance, preferably, the position and the number of the mouths 24*d* are adjusted to lengthen the heat transfer passages as much as possible within an allowance of the deflection amount of the thermal conduction aid 27.

Figure 14:
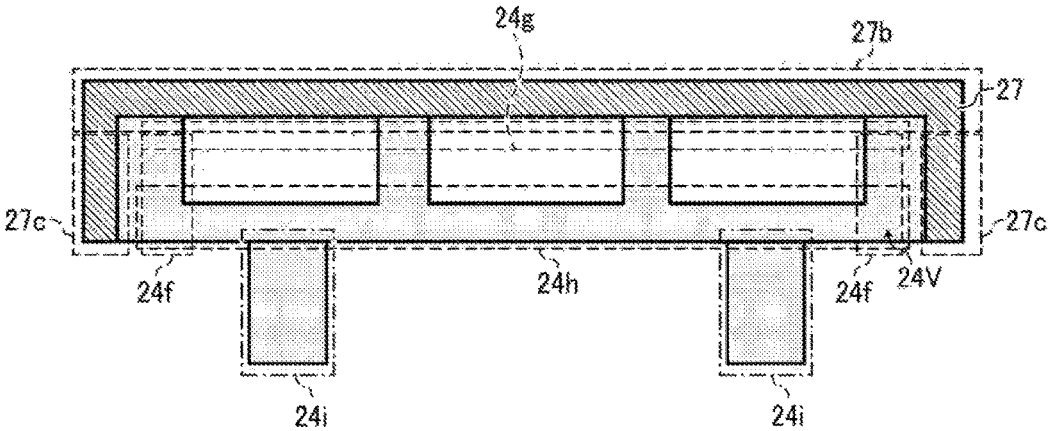
FIG. 14 is a cross-sectional view of the thermal conduction aid and the nip formation pad of FIG. 13, illustrating configurations thereof.

FIG. 14 is a cross-sectional view of the thermal conduction aid 27 and the nip formation pad 24V, illustrating configurations thereof.

It is to be noted that identical reference numerals are assigned to portions of the thermal conduction aid 27 and the nip formation pad 24V illustrated in FIG. 14 that are identical to the portions of the thermal conduction aid 27 and the nip formation pad 24 illustrated in FIG. 10. A description of the identical portions is herein omitted.

Figure 15:
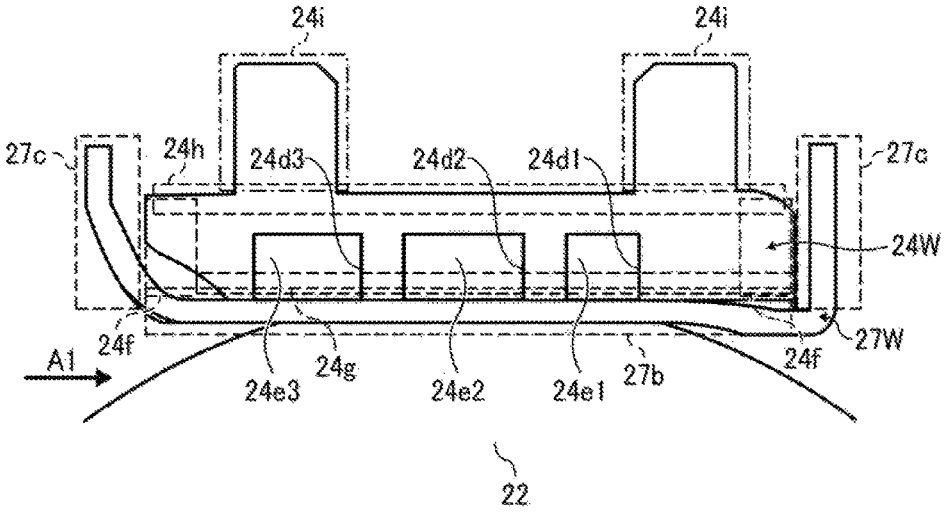
FIG. 15 is a cross-sectional view of a variation of the thermal conduction aid and another variation of the nip formation pad of FIG. 8 in a short direction thereof.

Referring now to FIG. 15, a description is given of a configuration of a nip formation pad 24W as another variation of the nip formation pad 24Z described above.

FIG. 15 is a cross-sectional view of a thermal conduction aid 27W as a variation of the thermal conduction aid 27 and the nip formation pad 24W in a short direction thereof.

Like the nip formation pad 24V described above, the nip formation pad 24W includes the three mouths 24*d*1, 24*d*2, and 24*d*3 arranged side by side in the short direction thereof. The mouths 24*d*1, 24*d*2, and 24*d*3 define the openings 24*e*1, 24*e*2, and 24*e*3, respectively. The openings 24*e*1, 24*e*2, and 24*e*3 are non-contact areas in which the nip formation pad 24W does not contact the thermal conduction aid 27W. As illustrated in FIG. 15, the thermal conduction aid 27W is shaped to reduce friction between the thermal conduction aid 27W and the fixing belt 21 that slides over the thermal conduction aid 27W. In addition, the thermal conduction aid 27W is shaped to facilitate conveyance of the sheet P through the fixing nip N and separation of the sheet P from the fixing belt 21 after a toner image is fixed onto the sheet P. Specifically, the thermal conduction aid 27W has a curvature that does not damage the fixing belt 21 upstream in the direction of sheet conveyance A1. On the other hand, the thermal conduction aid 27W is inclined or projects toward the pressure roller 22 downstream in the direction of sheet conveyance A1. The nip formation pad 24W has a shape that conforms to a shape of the thermal conduction aid 27W. Preferably, the position and the number of the mouths 24*d* are adjusted as described above.

It is to be noted that identical reference numerals are assigned to portions of the thermal conduction aid 27W and the nip formation pact 24W illustrated in FIG. 15 that are identical to the portions of the thermal conduction aid 27 and the nip formation pad 24 illustrated in FIG. 10. A description of the identical portions is herein omitted.

Figure 16:
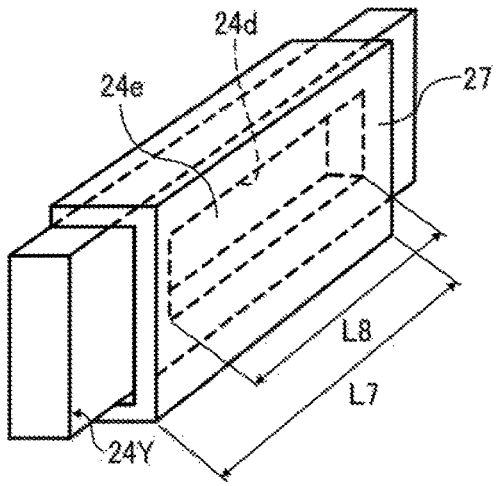
FIG. 16 is a schematic perspective view of the nip formation pad of FIG. 7 provided with the thermal conduction aid.

FIG. 16 is a schematic perspective view of the nip formation pad 24Y provided with the thermal conduction aid 27. For the sake of simplicity, the lateral end heaters 26*a* and 26*b* and the recesses 24*a* and 24*b* illustrated in FIG. 4 are omitted.

The thermal conduction aid 27 has a length L5 in the longitudinal direction thereof. On the other hand, the mouth 24*d* of the nip formation pad 24Y has a length L6 in the longitudinal direction thereof. As illustrated in FIG. 16, the length L6 of the mouth 24*d* of the nip formation pad 24Y is smaller than the length L5 of the thermal conduction aid 27. Opposed lateral ends of the nip formation pad 24Y support opposed lateral ends of the thermal conduction aid 27 in the longitudinal direction thereof. That is, the mouth 24*d*1 is disposed inboard from the opposed lateral ends of the thermal conduction aid 27 in the longitudinal direction thereof. This configuration reduces the deflection amount of the thermal conduction aid 27 when pressure is exerted in a direction perpendicular to the nip-side face 24*c* of the nip formation pad 24Y.

In the embodiment described above, the thermal conduction aid 27 and the nip formation pad 24 are incorporated in the fixing device 20 that includes the lateral end heater 26 (i.e., lateral end heaters 26*a* and 26*b*) on the nip formation pad 24. Alternatively, the thermal conduction aid 27 and the nip formation pad 24 may be incorporated in a fixing device 20S that does not include the lateral end heater 26.

Figure 17:
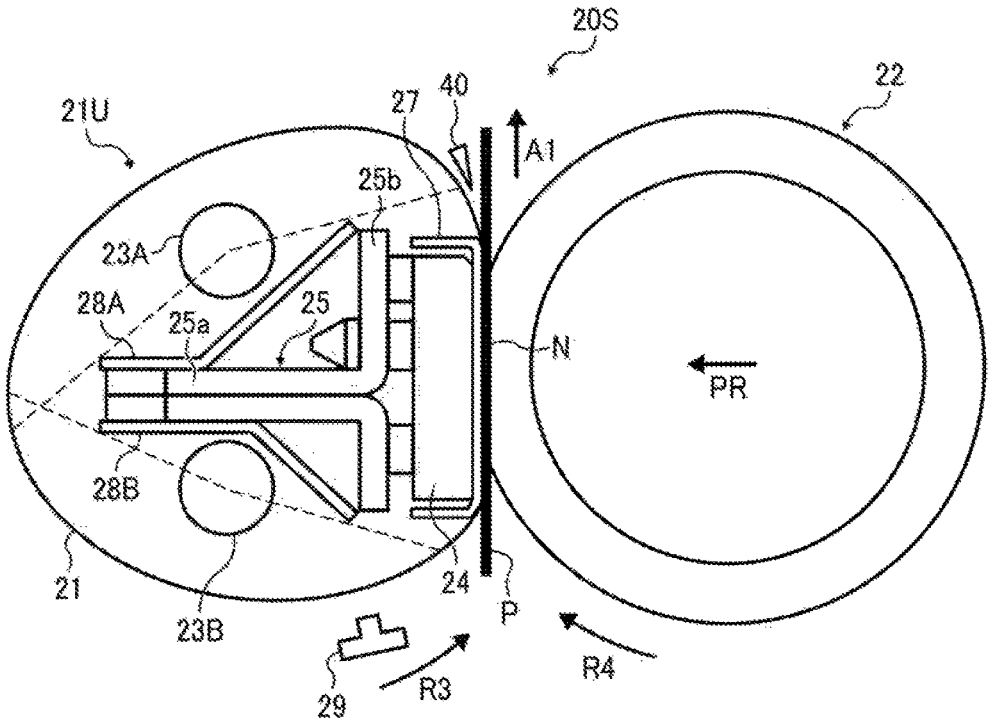
FIG. 17 is a schematic cross-sectional view of a fixing device without a lateral end heater.
Figure 18:
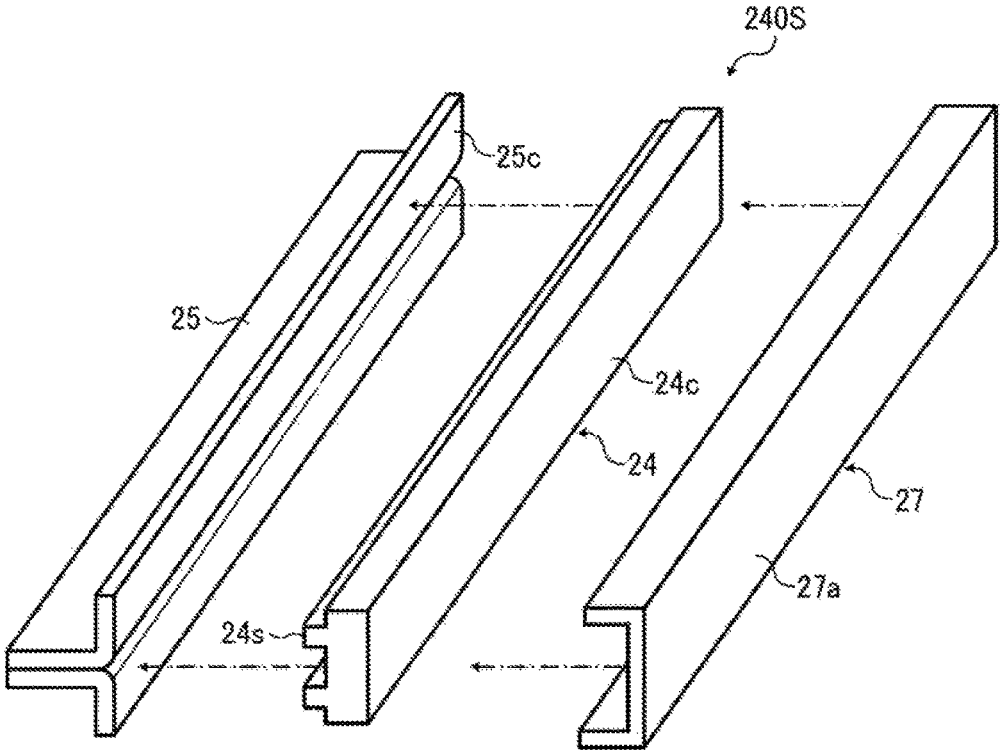
FIG. 18 is an exploded perspective view of a nip formation unit incorporated in the fixing device of FIG. 17.

Referring now to FIGS. 17 and 18, a description is given of the fixing device 20S.

FIG. 17 is a schematic cross-sectional view of the fixing device 20S. FIG. 18 is an exploded perspective view of a nip formation unit 240S incorporated in the fixing device 20S.

FIG. 17 illustrates a construction of the fixing device 20S identical to the construction of the fixing device 20 illustrated in FIG. 2. However, unlike the fixing device 20, the fixing device 20S does not include the lateral end heater 26. FIG. 18 illustrates a construction of the nip formation unit 240 that is identical to the construction of the nip formation unit 240 illustrated in FIG. 4. However, unlike the nip formation unit 240, the nip formation unit 240S does not include the lateral end heater 26 on the nip formation pad 24. It is to be noted that identical reference numerals are assigned to the components of the fixing device 20S and the nip formation unit 240S illustrated in FIGS. 17 and 18, respectively, that are identical to the components of the fixing device 20 and the nip formation unit 240 illustrated in FIGS. 2 and 4, respectively. A detailed description of the identical components is herein omitted.

A description is given of advantages of the fixing devices 20 and 20S according to the embodiments, examples, and variations described above.

As illustrated in FIG. 2, a fixing device (e.g., fixing device 20) includes a fixing rotator (e.g., fixing belt 21), a heater (e.g., heater 23), a pressure rotator (e.g., pressure roller 22), a pressure pad (e.g., nip formation pad 24), a support (e.g., stay), and a thermal conduction aid (e.g., thermal conduction aid 27). The fixing rotator is a flexible, endless belt formed into a loop and rotatable in a predetermined direction of rotation (e.g., direction of rotation R3). The heater heats the fixing rotator. The pressure rotator is disposed opposite an outer circumferential surface of the fixing rotator. The pressure pad is disposed inside the loop formed by the fixing rotator, opposite an inner circumferential surface of the fixing rotator. The pressure rotator presses against the pressure rotator via the fixing rotator and forms a fixing nip (e.g., fixing nip N) between the fixing rotator and the pressure rotator. As illustrated in FIG. 4, the pressure pad includes a nip-side face (e.g., nip-side face 24*c*) disposed opposite the inner circumferential surface of the fixing rotator. The support supports the pressure pad. The thermal conduction aid covers the nip-side face of the pressure pad and conducts heat in an axial direction of the fixing rotator. As illustrated in FIG. 5, the nip-side face of the pressure pad includes at least one mouth (e.g., mouth 24*d*) therein defining a non-contact area (e.g., opening 24*e*) of the pressure pad. The pressure pad does not contact the thermal conduction aid in the non-contact area of the pressure pad.

Accordingly, the pressure pad suppresses heat transfer from the thermal conduction aid, which does not contribute to a fixing operation, thereby reducing power consumption of the fixing device.

According to the embodiments of the present disclosure, the fixing device includes the thermal conduction aid that covers the nip-side face of the pressure pad that is disposed opposite the inner circumferential surface of the fixing rotator. Accordingly, the fixing device eliminates uneven heating of the fixing rotator in the axial direction thereof while a recording medium bearing a toner image is conveyed through the fixing nip. The nip-side face of the pressure pad includes a mouth that defines a non-contact area of the pressure pad therein. In the non-contact area of the pressure pad, the pressure pad does not contact the thermal conduction aid. Accordingly, the fixing device reduces heat transfer from the fixing rotator to the pressure pad, thereby reducing power consumption.

According to the embodiments described above, the fixing belt 21 serves as a fixing rotator. Alternatively, a fixing film, a fixing sleeve, or the like may be used as a fixing rotator. Further, the pressure roller 22 serves as a pressure rotator. Alternatively, a pressure belt or the like may be used as a pressure rotator.

Although the present disclosure makes reference to specific embodiments, it is to be noted that the present disclosure is not limited to the details of the embodiments described above and various modifications and enhancements are possible without departing from the scope of the present disclosure. It is therefore to be understood that the present disclosure may be practiced otherwise than as specifically described herein. For example, elements and/or features of different embodiments may be combined with each other and or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

What is claimed is:

1. A fixing device comprising:

a fixing rotator formed into a loop and rotatable in a predetermined direction of rotation;

a heater to heat the fixing rotator;

a pressure rotator disposed opposite an outer circumferential surface of the fixing rotator;

a pressure pad disposed opposite an inner circumferential surface of the fixing rotator to press against the pressure rotator via the fixing rotator to form a fixing nip between the fixing rotator and the pressure rotator, the pressure pad including a nip-side face disposed opposite the inner circumferential surface of the fixing rotator;

a support to support the pressure pad; and a thermal conduction aid to conduct heat in an axial direction of the fixing rotator, the thermal conduction aid covering the nip-side face of the pressure pad, the nip-side face of the pressure pad including at least one mouth defining a non-contact area of the pressure pad in the at least one mouth, in which the pressure pad does not contact the thermal conduction aid, and the support contacts the pressure pad in a range corresponding to the non-contact area of the pressure pad as seen from the nip-side face of the pressure pad.

2. The fixing device according to claim 1, wherein the pressure pad further comprises a convex contact portion coupled to the support, and wherein the convex contact portion of the pressure pad contacts the support in a range corresponding to the non-contact area as seen from the nip-side face of the pressure pad.

3. The fixing device according to claim 1, wherein the support further comprises a convex contact portion coupled to the pressure pad, and wherein the convex contact portion of the support contacts the pressure pad in a range corresponding to the non-contact area as seen from the nip-side face of the pressure pad.

4. The fixing device according to claim 1, wherein the at least one mouth of the pressure pad has a continuous, identical width over a given length in a longitudinal direction of the pressure pad.

5. The fixing device according to claim 4, wherein the at least one mouth of the pressure pad includes a first mouth and a second mouth, and wherein the first mouth and the second mouth are arranged side by side in a short direction of the pressure pad.

6. The fixing device according to claim 1, wherein the nip-side face of the pressure pad further includes a contact area in which the pressure pad contacts the thermal conduction aid, and wherein the contact area includes at least a position at which the nip-side face of the pressure pad is subjected to a maximum pressure.

7. The fixing device according to claim 1, wherein a size and a number of the at least one mouth is determined such that the nip-side face of the pressure pad is subjected to a desired surface pressure.

8. The fixing device according to claim 5, wherein the second mouth is disposed upstream from the first mouth in a direction of recording medium conveyance, wherein each of the first mouth and the second mouth defines a non-contact area in which the pressure pad does not contact the thermal conduction aid, and wherein the non-contact area defined by the second mouth is larger than the non-contact area defined by the first mouth.

9. The fixing device according to claim 1, wherein the at least one mouth is disposed inboard from opposed lateral ends of the thermal conduction aid in a longitudinal direction of the thermal conduction aid.

10. The fixing device according to claim 1, further comprising a lateral end heater on a lateral end of the pressure pad in a longitudinal direction of the pressure pad.

11. The fixing device according to claim 10, wherein the lateral end heater is a contact-type, heat-transfer heater.

12. The fixing device according to claim 1, wherein the fixing rotator is a flexible, endless belt.

13. The fixing device according to claim 1, wherein the pressure pad has a shape conforming to a shape of the thermal conduction aid.

14. An image forming apparatus comprising:

an image forming device to form a toner image; and the fixing device according to claim 1, the fixing device being disposed downstream from the image forming device in a direction of recording medium conveyance to fix the toner image on a recording medium.

15. A fixing device comprising:

a fixing rotator formed into a loop and rotatable in a predetermined direction of rotation;

a heater to heat the fixing rotator;

a pressure rotator disposed opposite an outer circumferential surface of the fixing rotator;

a pressure pad disposed opposite an inner circumferential surface of the fixing rotator to press against the pressure rotator via the fixing rotator to form a fixing nip between the fixing rotator and the pressure rotator, the pressure pad including a nip-side face disposed opposite the inner circumferential surface of the fixing rotator;

a support to support the pressure pad; and a thermal conduction aid to conduct heat in an axial direction of the fixing rotator, the thermal conduction aid covering the nip-side face of the pressure pad, the nip-side face of the pressure pad including at least one mouth defining a non-contact area of the pressure pad in the at least one mouth, in which the pressure pad does not contact the thermal conduction aid, the nip-side face of the pressure pad further includes a contact area in which the pressure pad contacts the thermal conduction aid, and the contact area includes at least a position at which the nip-side face of the pressure pad is subjected to a maximum pressure.

16. A fixing device comprising:

a fixing rotator formed into a loop and rotatable in a predetermined direction of rotation;

a heater to heat the fixing rotator;

a pressure rotator disposed opposite an outer circumferential surface of the fixing rotator;

a pressure pad disposed opposite an inner circumferential surface of the fixing rotator to press against the pressure rotator via the fixing rotator to form a fixing nip between the fixing rotator and the pressure rotator, the pressure pad including a nip-side face disposed opposite the inner circumferential surface of the fixing rotator;

a support to support the pressure pad; and a thermal conduction aid to conduct heat in an axial direction of the fixing rotator, the thermal conduction aid covering the nip-side face of the pressure pad, the nip-side face of the pressure pad including at least one mouth defining a non-contact area of the pressure pad in the at least one mouth, in which the pressure pad does not contact the thermal conduction aid, and a size and a number of the at least one mouth is determined such that the nip-side face of the pressure pad is subjected to a desired surface pressure.

* * * * *